US009470464B2

(12) United States Patent
Kielsmeier et al.

(10) Patent No.: US 9,470,464 B2
(45) Date of Patent: Oct. 18, 2016

(54) SELF-LEVELING FOLLOWER AND MAGAZINE

(71) Applicant: Magpul Industries Corp., Boulder, CO (US)

(72) Inventors: Nicholas Kielsmeier, Denver, CO (US); Brian L. Nakayama, Arvada, CO (US)

(73) Assignee: MAGPUL INDUSTRIES CORP., Austin, TX (US)

( * ) Notice: Subject to any disclaimer, the term of this patent is extended or adjusted under 35 U.S.C. 154(b) by 0 days.

(21) Appl. No.: 14/687,864

(22) Filed: Apr. 15, 2015

(65) Prior Publication Data

US 2015/0292826 A1 Oct. 15, 2015

Related U.S. Application Data

(60) Provisional application No. 61/979,944, filed on Apr. 15, 2014.

(51) Int. Cl.
*F41A 9/70* (2006.01)

(52) U.S. Cl.
CPC ..... *F41A 9/70* (2013.01)

(58) Field of Classification Search
CPC ..... F41A 9/70
USPC ..... 42/50
See application file for complete search history.

(56) References Cited

U.S. PATENT DOCUMENTS 3,087,270 A 4/1963 Stoner
3,395,479 A 8/1968 Collins
3,453,762 A 7/1969 Fremont
4,446,645 A 5/1984 Kelsey et al.
4,502,237 A * 3/1985 Krogh ..... F41A 9/70 42/50
4,589,218 A 5/1986 Teppa
4,811,510 A * 3/1989 Chesnut ..... F41A 9/70 42/50
5,113,605 A 5/1992 Kim
5,149,897 A 9/1992 Howard (Continued)

FOREIGN PATENT DOCUMENTS

DE 3208504 A1 9/1983
EP 1738130 A1 1/2007

(Continued)

OTHER PUBLICATIONS

"Plastic Injection Molding Tolerance Guide", Jun. 8, 2014, Star Prototype Manufacturing Co. Ltd, pp. 1 and 2.*

(Continued)

*Primary Examiner* — Troy Chambers
*Assistant Examiner* — Joshua Semick
(74) *Attorney, Agent, or Firm* — Neugeboren O'Dowd PC

(57) ABSTRACT

A follower for a firearm magazine is disclosed, with a platform that may support a cartridge and has a top surface defining a plane and a bottom surface. The front end may be coupled to a front portion of the platform and engage a spring and a magazine body. The interior surface of the front end may be substantially perpendicular to the bottom surface of the platform and form an obtuse angle with the plane of the platform. The rear end may be coupled to a rear portion of the platform and engage the spring and the magazine body. The interior surface of the rear end may be perpendicular to the bottom surface of the platform and form an acute angle with the plane of the platform. The front end may extend further below the platform than does the rear end.

23 Claims, 13 Drawing Sheets

(56) References Cited

U.S. PATENT DOCUMENTS

| | | | | |
|---|---|---|---|---|
| 5,309,660 | A | 5/1994 | Blackamore | |
| 5,956,878 | A | 9/1999 | Yang | |
| 6,560,907 | B1 | 5/2003 | Vieweg | |
| 6,952,894 | B1 | 10/2005 | Vieweg | |
| 7,093,386 | B1 | 8/2006 | Vieweg | |
| 7,533,483 | B1 | 5/2009 | Alazmora et al. | |
| 7,621,063 | B2 | 11/2009 | Fitzpatrick et al. | |
| D615,143 | S | 5/2010 | Fitzpatrick et al. | |
| 7,908,780 | B2 | 3/2011 | Fitzpatrick et al. | |
| 7,958,660 | B2 | 6/2011 | Fitzpatrick et al. | |
| D644,293 | S | 8/2011 | Fitzpatrick et al. | |
| 8,006,423 | B1 | 8/2011 | Alzamora et al. | |
| D645,113 | S | 9/2011 | Fitzpatrick et al. | |
| 8,069,601 | B1 | 12/2011 | Fitzpatrick et al. | |
| 8,166,692 | B2 | 5/2012 | Fitzpatrick et al. | |
| 8,407,922 | B1 | 4/2013 | Taylor | |
| 8,468,730 | B2 | 6/2013 | Faifer et al. | |
| 8,635,796 | B2 | 1/2014 | Fitzpatrick et al. | |
| 8,650,787 | B2 | 2/2014 | McCormick | |
| 8,667,724 | B2 | 3/2014 | Zheng | |
| D719,235 | S | 12/2014 | Mikroulis | |
| 8,959,818 | B2 | 2/2015 | Mayerl | |
| 8,966,801 | B1 | 3/2015 | Bentley | |
| 9,170,062 | B2 * | 10/2015 | Corso | F41A 9/65 |
| 2006/0236580 | A1 * | 10/2006 | Szabo | F41A 9/70 42/50 |
| 2007/0157501 | A1 | 7/2007 | Cammenga et al. | |
| 2010/0101132 | A1 | 4/2010 | Jacobson | |
| 2011/0005113 | A1 | 1/2011 | Fitzpatrick et al. | |
| 2011/0277366 | A1 | 11/2011 | Steffes et al. | |
| 2011/0308128 | A1 | 12/2011 | Wright | |
| 2013/0167420 | A1 | 7/2013 | Zheng | |
| 2013/0180146 | A1 | 7/2013 | Fitzpatrick et al. | |
| 2013/0227870 | A1 | 9/2013 | Rendullic | |
| 2014/0096755 | A1 | 4/2014 | Larmer et al. | |
| 2014/0259844 | A1 | 9/2014 | Kruse | |
| 2014/0352189 | A1 | 12/2014 | Fitzpatrick et al. | |
| 2014/0366417 | A1 | 12/2014 | Zheng | |
| 2015/0059222 | A1 | 3/2015 | Corso | |

FOREIGN PATENT DOCUMENTS

| | | | |
|---|---|---|---|
| WO | 2009025889 | A3 | 6/2009 |
| WO | 2013050038 | A1 | 4/2013 |
| WO | 2013109792 | A3 | 10/2014 |

OTHER PUBLICATIONS

Heckler & Koch, "HK G36 Magazine Follower", Webpage found at http://www.hkparts.net/shop/pc/G36-Magazine-Follower-HK-G36-182p16343.htm Inventor(s) aware of prior art on or before May 22, 2015, p. 2, Published in: US.

Msar, "Mar. 20, 2015—It's been Quite the Journey . . . ", Webpage found at http://www.msarinc.com/ Inventor(s) aware of prior art on or before May 22, 2015, p. 2, Published in: US.

Allemann AG, "SIG 550 Series 30 Round Magazine Buy 5 for Free Shipping", Webpage found at http://www.prebanarmory.com/sig-550-30-rd-magazine/ Inventor(s) aware of prior art on or before May 22, 2015, p. 2, Published in: US.

Steyr, "Steyr AUG 30 Round Black Magazine", Webpage found at http://www.steyrarms.com/store/index.php/accessories/aug-accessories/auto-2.html Inventor(s) aware of prior art on or before May 22, 2015, p. 2, Published in: US.

Prawiradiraja, Theodore, "International Search Report and Written Opinion re Application No. PCT/US2015/026038", Oct. 14, 2015, p. 10, Published in: AU.

Prawiradiraja, Theodore, "Australian Office Action re Application No. 2015202498", Oct. 12, 2015, p. 6, Published in: AU.

* cited by examiner

SELF-LEVELING FOLLOWER AND MAGAZINE

CROSS-REFERENCE TO RELATED APPLICATIONS

This application claims priority to U.S. Provisional Application No. 61/979,944 filed Apr. 15, 2014 and entitled "SELF-LEVELING FOLLOWER AND MAGAZINE," the entire disclosure of which is hereby incorporated by reference for all purposes, as if fully set forth herein.

FIELD OF THE DISCLOSURE

The present invention relates to the field of ammunition magazines and more particularly relates to an anti-tilt follower for said magazines.

BACKGROUND

Followers are well known in the prior art and are regularly used in dispensing systems for uniform items. One such system is an ammunition magazine, whereby ammunition cartridges are individually dispensed from the magazine into the chamber of a firearm. Magazine and follower systems in the prior art have always had a possibility of jamming when in use due to the existence of low precision relative to the various degrees of freedom that the follower has within the magazine. As a result, the rapidity of fire, the possibility of damage to the magazine, and jarring of the rounds and the follower (e.g., when dropped) can all lead to jamming. For instance, rapid fire creates vibrations that can cause misalignment of the rounds and follower, and rapid fire also can prevent realignment of components that might realign under slow rate of fire conditions. As another example, damage to a magazine can cause misalignment of the rounds and/or the rounds and the follower. Further, jarring of the magazine given the low precision and numerous degrees of freedom of the follower, can lead to restacking or bouncing of the follower out of position Self-leveling followers have helped to mitigate jams in the magazine, but in certain cases, the structure of a self-leveling follower can actually lead to new and unforeseen issues. In particular, there are many firearms platforms where optimum round feeding occurs when a top surface of the follower has a slight ascending angle of incidence from front to back when compared to a plane that is perpendicular to a magazine casing at any elevation within the magazine (i.e., regardless of the number of rounds remaining). The Steyr AUG (translated "universal army rifle") platform is just one of many such platforms. The Steyr AUG is an Austrian bullpup rifle chambering 5.56 mm rounds and used by various national armed forces as well as the Austrian Bundesheer and the U.S. Immigration and Customs Enforcement agency. In the art, followers have been used that are not self-leveling and as a result they have a greater ability to rotate front to back than self-leveling followers. In the Steyr AUG and similar systems the shape of the magazine, round interface with the receiver, and the configuration of the rounds, leads the follower to naturally tip slightly and thereby achieve a top surface of the follower having a slightly upward angle of incidence. Self-leveling followers are unable to naturally tilt and thus unable to achieve the optimum angle of incidence for the top surface of the follower. There is thus a need in the art for a self-leveling follower designed for the Steyr AUG and similar systems that can achieve the above-described optimum angle of incidence for the top surface of the follower.

SUMMARY

Embodiments disclosed herein address the above needs by providing a follower for a firearm magazine. In some embodiments, the follower has a platform, a front end, and a rear end. The platform may be shaped to support a cartridge and have a top surface and a bottom surface, the top surface defining at least one plane. The front end may be coupled to a front portion of the platform and have an interior surface for engaging a spring and an exterior surface for engaging a magazine body. The interior surface of the front end may be substantially perpendicular to the bottom surface of the platform and form an obtuse angle with the at least one plane of the platform. The rear end may be coupled to a rear portion of the platform and have an interior surface for engaging the spring and an exterior surface for engaging a magazine body. The interior surface of the rear end may be perpendicular to the bottom surface of the platform and form an acute angle with the at least one plane of the platform. The front end may extend further below the platform than does the rear end.

In some embodiments, the platform is shaped to support a cartridge and has a top surface and a bottom surface, the top surface defining at least one plane of the follower and a normal of the bottom surface of the platform defines a vertical axis of the follower. A front end may be coupled to a front portion of the platform, and a rear end may be coupled to a rear portion of the platform. An interior surface of the front end and an interior surface of the rear end may form perpendicular angles with the bottom surface of the platform to define a spring receiving space shaped to limit an upper portion of a magazine spring to vertical compression when the upper portion of the magazine spring is compressed into the spring receiving space. The interior surface of the front end may form an obtuse angle with the at least one plane of the platform. The interior surface of the rear end may form an acute angle with the at least one plane of the platform.

In some embodiments, the platform is shaped to support a cartridge and has a top surface and a bottom surface, the top surface of the platform defining a first cartridge support plane and the bottom surface of the platform having a normal that defines a vertical axis of the follower. A front end may be coupled to a front portion of the platform such that an interior surface of the front end is perpendicular to the bottom surface of the platform and forms an obtuse angle with the first cartridge support plane. A rear end may be coupled to a rear portion of the platform such that an interior surface of the rear end is perpendicular to the bottom surface of the platform and forms an acute angle with the first cartridge support plane. The front end may extend further below the platform than the rear end.

DETAILED DESCRIPTION

Figure 1:
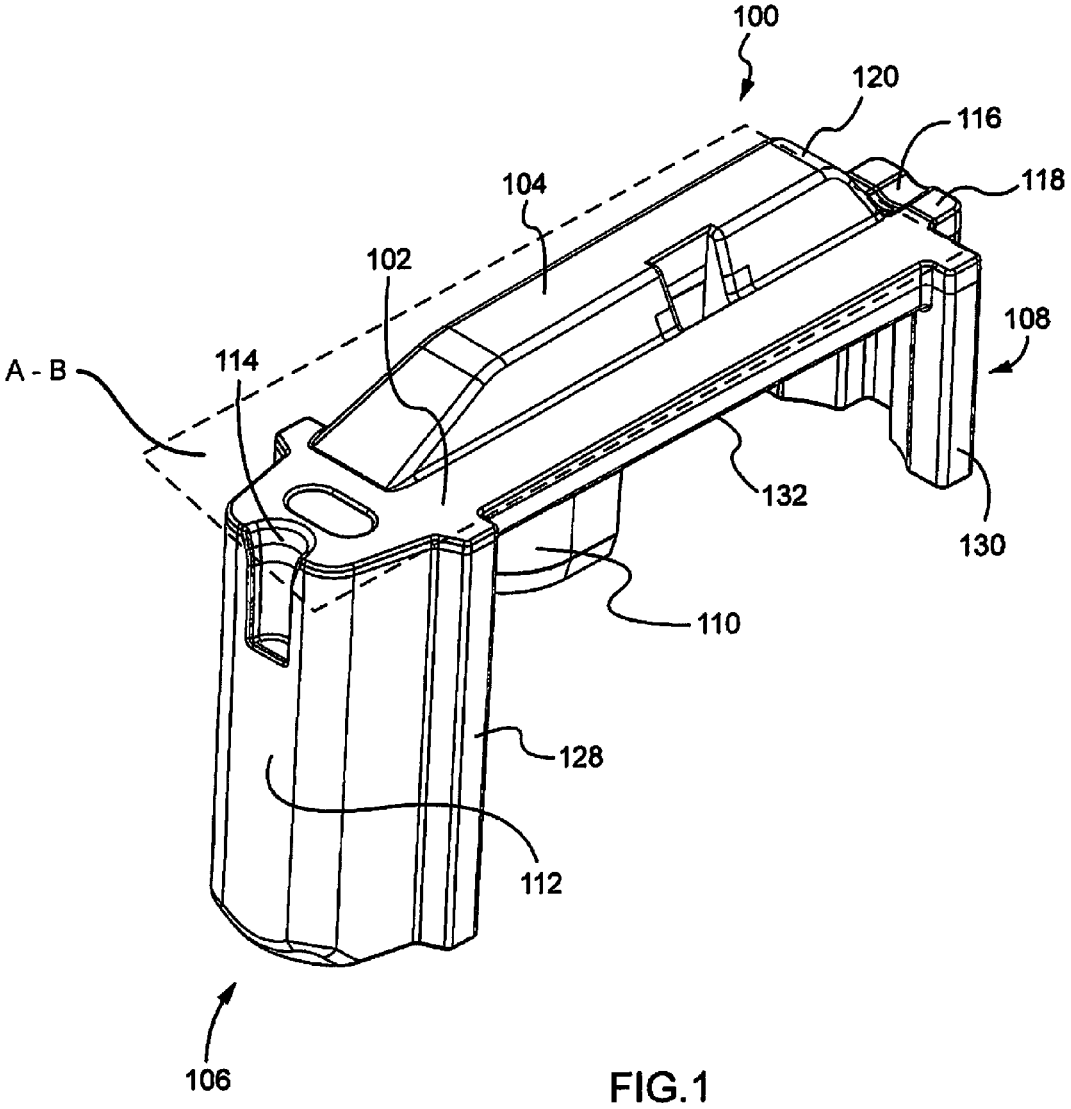
FIG. 1 is a perspective view of an exemplary follower.
Figure 2:
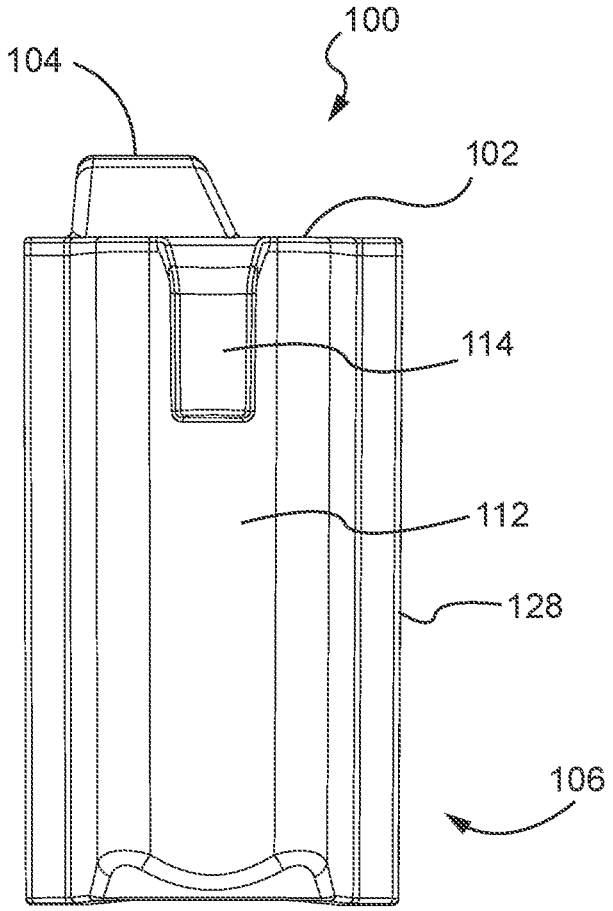
FIG. 2 is a front view of an exemplary follower.

With reference now to the drawings, an embodiment of the ammunition magazine follower 100 is herein described. It should be noted that the articles "a", "an" and "the", as used in this specification, include plural referents unless the content clearly dictates otherwise. It should also be understood that all absolute terms, including but not limited to terms such as "perpendicular", "equal to", "flat", and/or "parallel to" are to be understood as including "substantially within reasonable manufacturing tolerances . . . " even if the term "substantially" does not accompany the absolute phrase or term.

The follower 100 departs from the prior art in that it utilizes self-leveling features while also presenting a slightly inclined angle of incidence to the last two rounds in a magazine as measured relative to a perpendicular to a front inside wall of the magazine—regardless of the number of rounds remaining.

In some embodiments, the follower 100 also departs from the prior art in the radical downward extension of the front end 106 and optionally also of the rear end 108, shown in FIGS. 1-5. The extended front end 106 lessens the contortion of the follower 100 in relation to the spring and magazine casing as the follower 100 moves within the magazine during loading, unloading, and discharge of ammunition. This is particularly important with curved magazines since the curve forces the follower to traverse a bend. This front end 106 can be considered one of a number of self-leveling features that the follower 100 can embody.

The follower 100 can include an oblong follower floor or platform comprising a top surface 102 and a bottom surface 132 that may or may not be parallel to each other (as illustrated they are oblique). The front end 106 and the rear end 108 of the follower 100 may each extend downward from respective ends of the top surface 102 of the follower. As illustrated, the front end 106 and the rear end 108 may extend substantially perpendicularly and downward from the bottom surface 132 of the follower. The front end 106 can extend downward beyond a level defined by the spring nub 124. Optionally the rear end 108 may also extend downward beyond a level defined by the spring nub 124. As shown, the front end 106 may extend further below the bottom surface 132 of the follower than does the rear end 108. The front end 106 includes a front edge 112 that forms an obtuse angle with the top surface 102 of the follower and a perpendicular angle to the bottom surface 132 of the follower. The front edge 112 may include a travel stop 114 for engaging a top portion of the magazine and preventing the follower 100 from traveling more than is desired as cartridges are expended. The rear end 108 includes a rear edge 122 that forms an acute angle with the top surface 102 of the follower and a perpendicular angle to the bottom surface 132 of the follower. The front end 106 further includes at least one front fin, such as two front fins 128 on respective sides of the front end 106, while the rear end 108 includes at least one, such as two rear fins 130 on either side of the rear end 108.

Figure 7:
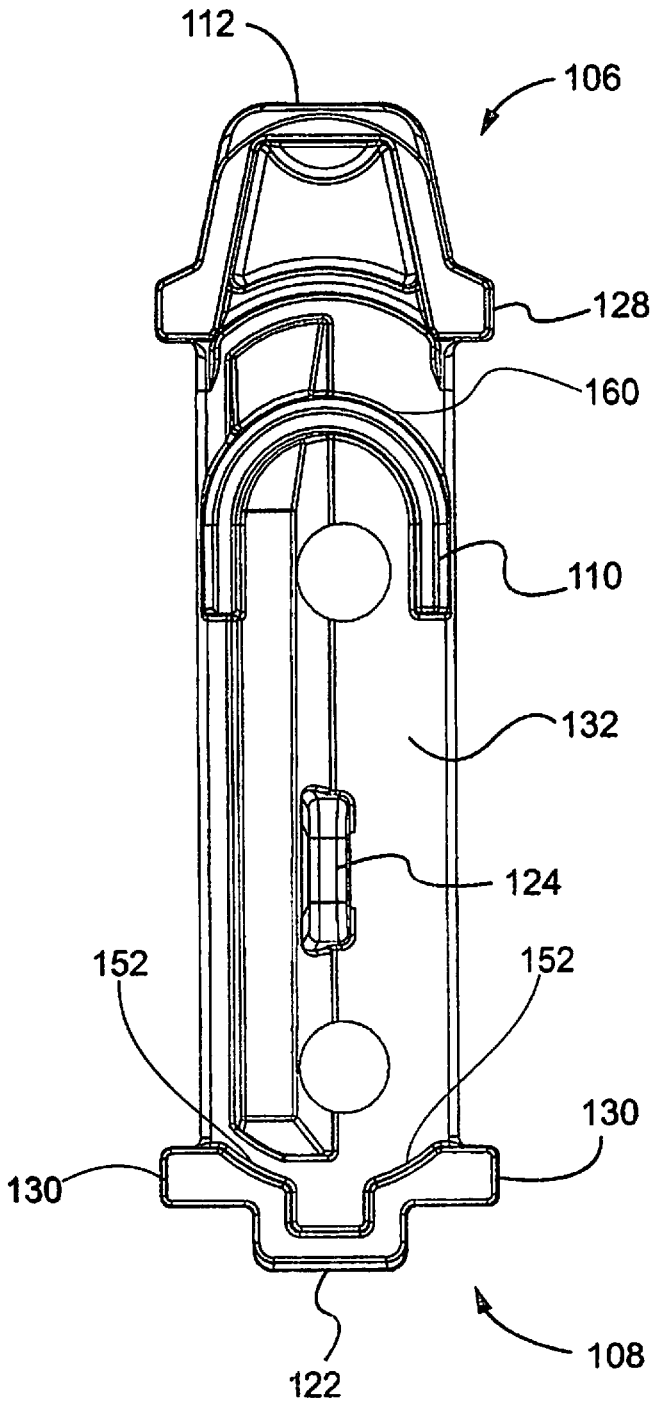
FIG. 7 is a bottom view of an exemplary follower.
Figure 8:
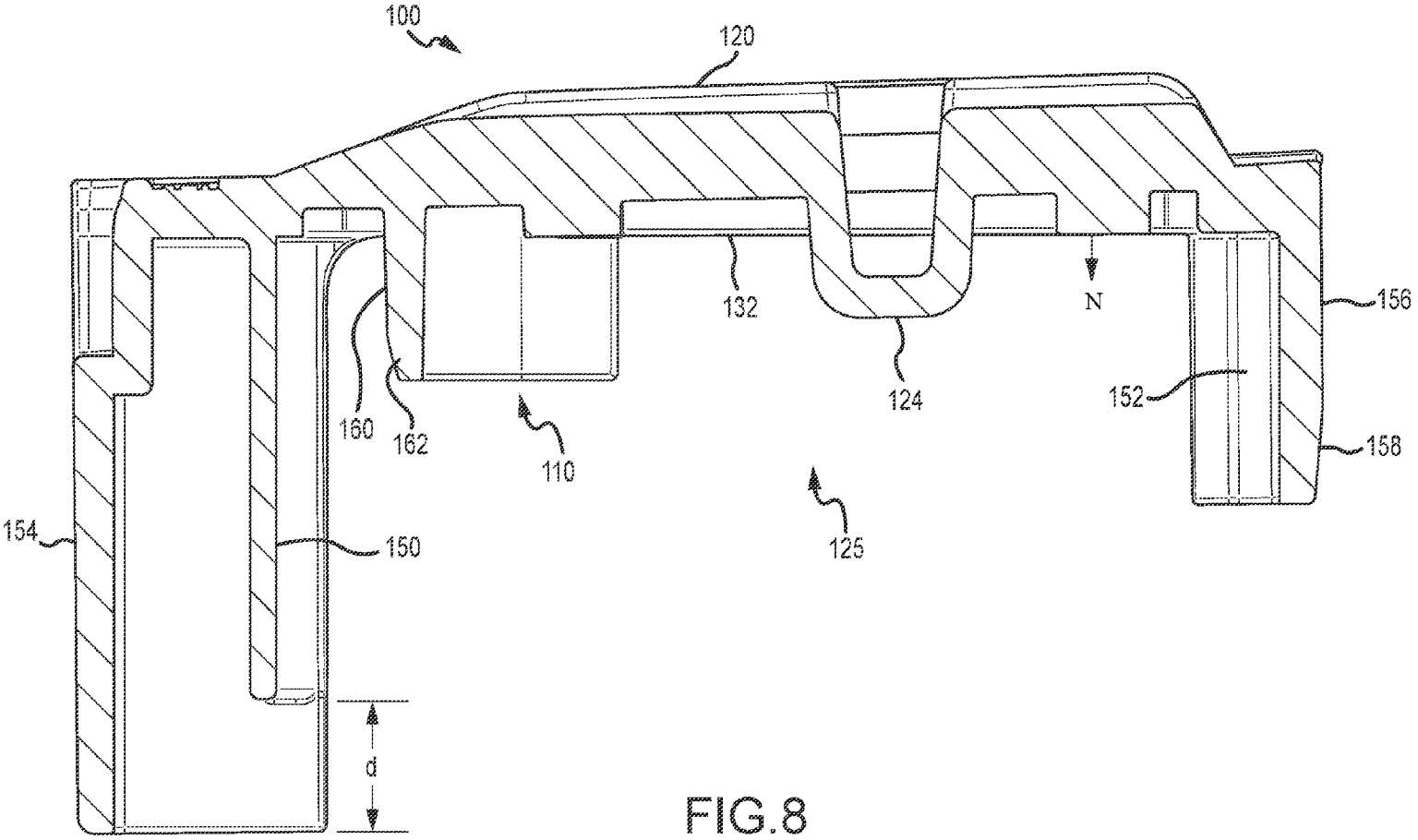
FIG. 8 is a side section view of an exemplary follower.

In some embodiments, an interior surface 150 of the front end is shaped to engage the spring (not illustrated), while an exterior surface of the front end is shaped to engage a magazine body, with the interior surface 150 of the front end being substantially perpendicular to the bottom surface 132 of the platform and forming an obtuse angle with at least one plane 103 defined by the top surface 102 of the platform. Similarly, a rear end 108 may be coupled to a rear portion of the platform and have an interior surface 152 that is shaped to engage the spring and an exterior surface shaped to engage a magazine body. See, for example, FIG. 7, illustrating a curvature of the interior surface 152. The interior surface 152 of the rear end may be perpendicular to the bottom surface 132 of the platform and form an acute angle with the plane 103 defined by the top surface of the platform. As can also be seen from FIG. 8, a normal N of the bottom surface 132 may be shaped to provide a surface against which the spring 127 may compress, and in some embodiments, the bottom surface 132 and the interior surfaces 150, 152 are shaped to limit the spring to vertical compression against the bottom surface 132, or parallel to the normal N. In some embodiments, the follower comprises a spring receive space 125 shaped to limit an upper portion of the spring to vertical compression when the upper portion of the spring (not illustrated) is compressed into the spring receiving space 125. In some embodiments, and as illustrated in FIG. 8, the follower 100 may have a spring retention wall 110 (see also FIG. 7) coupled to the platform and extending into the spring receiving space 125 between the front end 106 and the rear end 108. The spring retention wall 110 may be shaped to limit the upper portion of the spring 127 to vertical compression when the upper portion of the spring is compressed into the spring receiving space 125.

Figure 3:
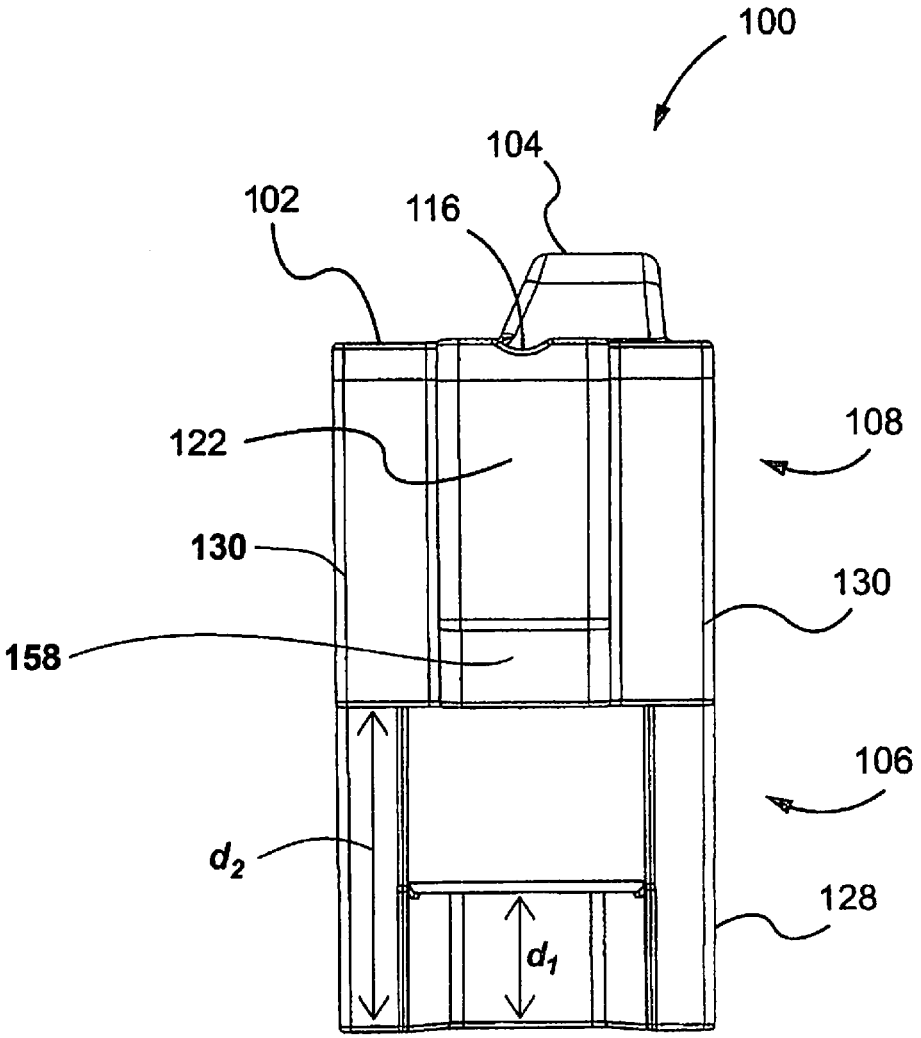
FIG. 3 is a rear view of an exemplary follower.

With reference to FIG. 3, the front end 106 may extend further from the platform than does the rear end. Moreover, an interior surface 150 of the front end 106 may not extend as far from the platform as does an exterior surface 154 of the front end 106 (see e.g. FIG. 8). That is, the exterior surface 154 may extend a distance d1 further from the platform than does the interior surface 150 of the front end 106. Similarly, exterior surface 154 of the front end 106 may extend a distance d2 further from the platform than does the rear end 108.

Figure 4:
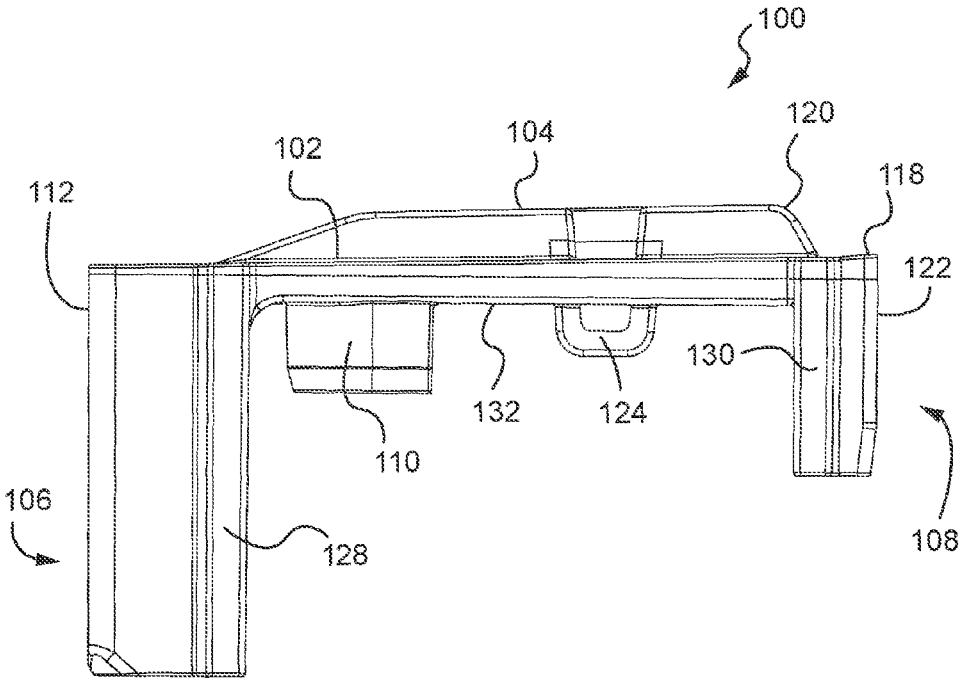
FIG. 4 is a first side view of an exemplary follower.

With continued reference to FIGS. 3 and 4, the rear end 108 may include a beveled lead-in 158 to allow the rear end 108 to more appropriately interface with the interior of a magazine.

Figure 9A:
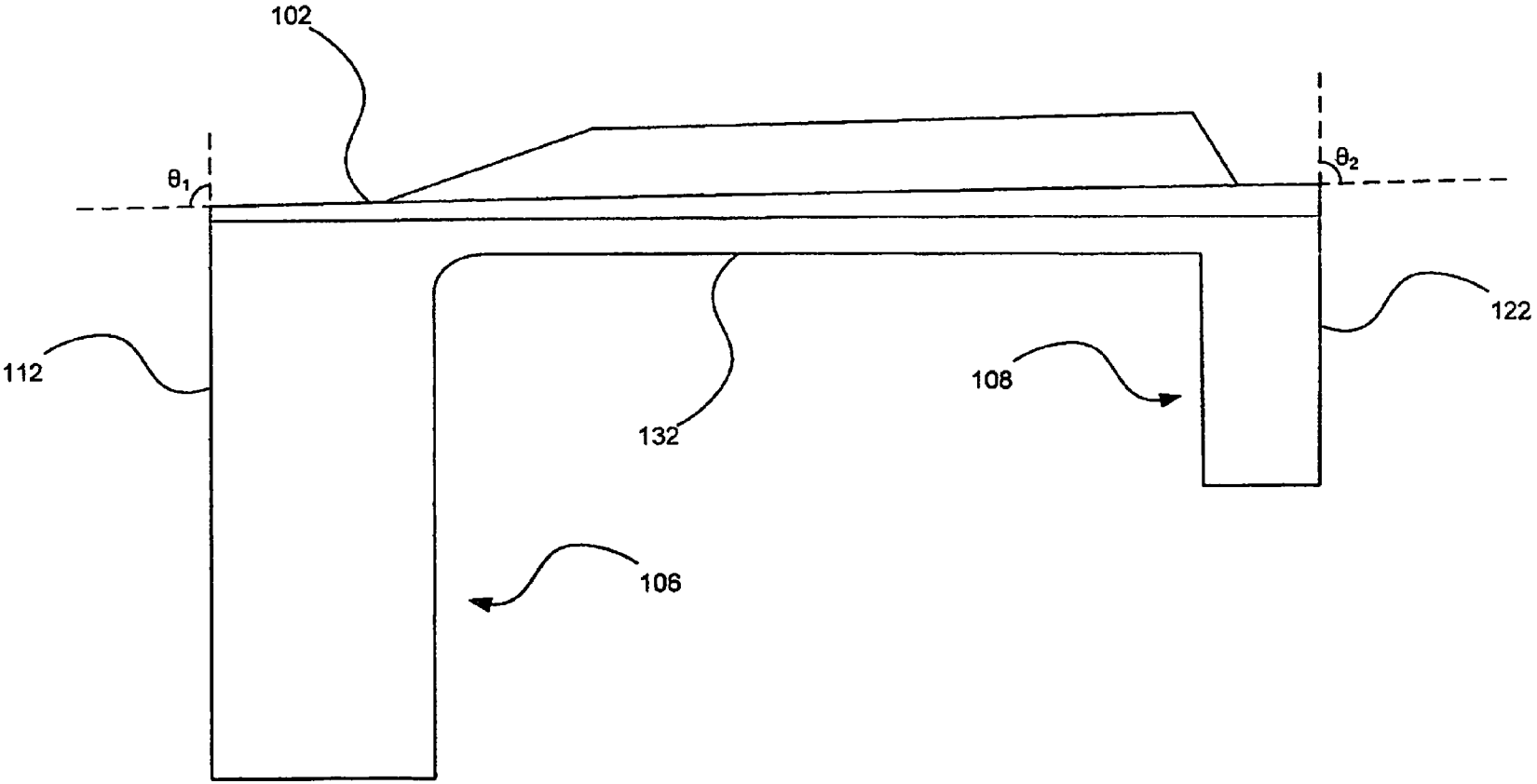
FIG. 9A is a first skeleton depiction of relationships between some features of the follower depicted in FIG. 1.

With reference to FIGS. 8 and 9A, in some embodiments, the interior surface 150 may be controlled to be at an angle relative to the top surface 102, without regard to the bottom surface 132. That is, the interior surface 150 of the front edge 112 may be at an obtuse angle, such as at an angle $\theta_1$, relative to a plane defined by the top surface 102 of the follower 100 without being substantially perpendicular to the bottom surface 132. Similarly, the interior surface 152 of the rear edge 122 may be at an acute angle, such as an angle $\theta_2$, relative to the plane defined by the top surface 102 of the follower without being substantially perpendicular to the bottom surface 132.

The follower 100 may further include a bolt stop interface or a stop shelf 118 having a slightly greater angle of incidence than a plane A-B defined by the top surface 102 of the follower 100. Underneath the follower 100 may be a spring nub 124 (see e.g. FIG. 8) projecting downward from the bottom surface 132 of the follower and that interfaces with a follower spring (not shown) in the magazine, while a spacer 104 supports one of the two columns of cartridges in a dual stacked magazine. The spacer 104 is arranged atop the top surface 102 of the follower and set to an extreme side of the top surface 102 of the follower. A top surface 120 of the spacer 104 can be parallel to the top surface 102 of the follower 100 (or parallel to a length of the follower 100), or the top surface 120 of the spacer 104 may be oblique to the top surface 102 of the platform, as illustrated in FIG. 9B.

The underside of the follower 100 may also include a spring retention wall 110 shaped to keep the spring properly aligned to the follower 100 within the magazine. In some embodiments, an exterior surface 160 (see e.g. FIG. 7) is shaped to engage an interior region of a spring (not shown) to retain the spring in a desired orientation as portions of the spring are compressed into the spring receiving space, with the spring receiving space being defined by the front end 106 and the rear end 108. Additional spring retention walls 110 can also be implemented, for instance a second spring retention wall can be formed near the rear end 108 or as part of the rear end 108.

Figure 9B:
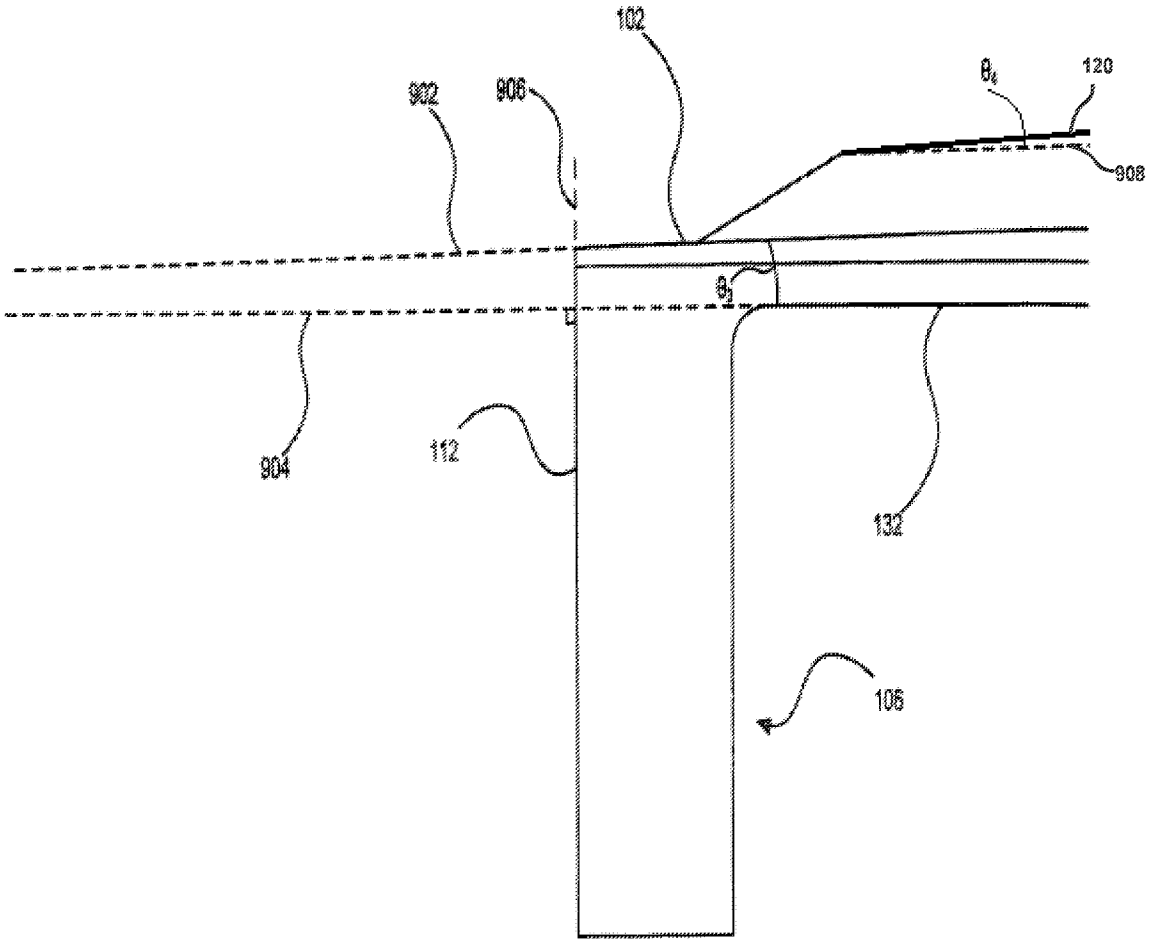
FIG. 9B is a is a second skeleton depiction of relationships between some features of the follower depicted in FIG. 1.

The top surface 102 of the follower platform forms an obtuse angle $\theta_1$ with a front edge 112 of the follower 100 as seen in FIGS. 9A-9B. Optionally, a rear edge 122 of the follower 100 can be parallel to the front edge 112, and accordingly can also make an acute angle $\theta_2$ with a majority of the top surface 102 of the follower, also as seen in FIGS. 9A-9B.

Figure 5:
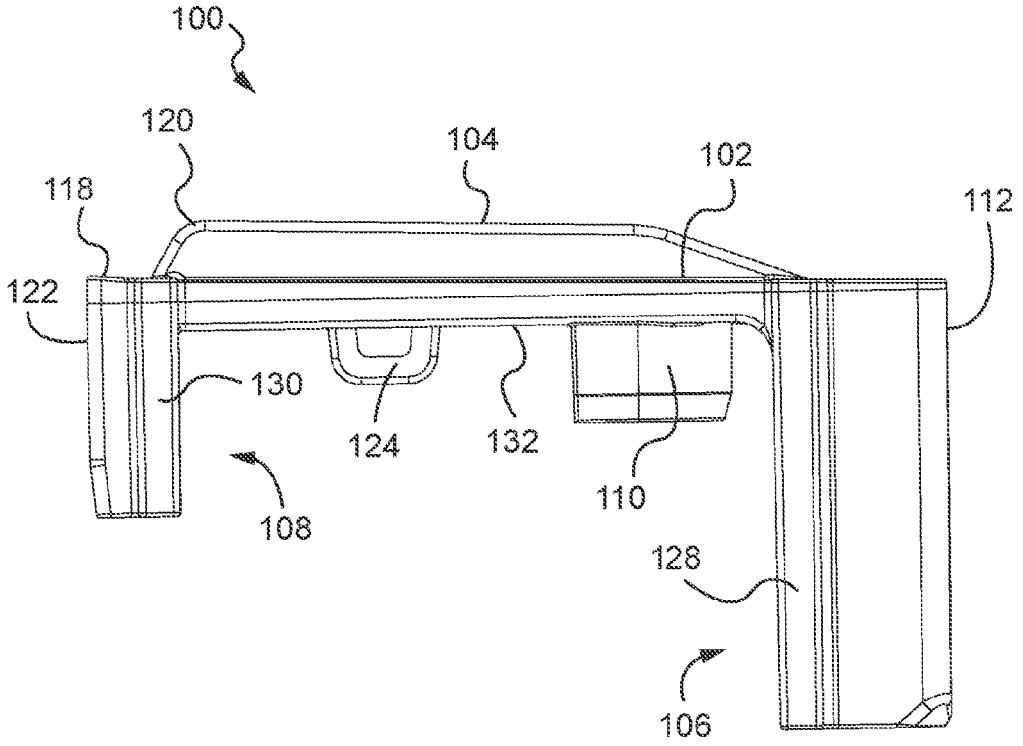
FIG. 5 is a second side view of an exemplary follower.

With reference to FIG. 5, a bolt stop interface 118 extending from or affixed to the follower platform 102 may have an even steeper angle, relative to the bottom surface 132 or vertical axis N, than does the top surface 102 of the follower platform 102, although this is not required. Providing an angled bolt stop interface 118 as illustrated in FIG. 5 may provide improved contact with a bolt stop in a weapon, further improving bolt stop reliability.

In some embodiments, the top surface 102 of the follower platform can form an acute angle $\theta_3$ with a bottom surface 132 of the follower platform, or can be said to be oblique to the bottom surface 132 of the follower platform, as seen in FIG. 9A. The oblong follower floor can be fixed to the front end 106 and optionally fixed to the rear end 108 such that the oblong follower floor and one or more of the front and rear ends 106, 108 are fixedly coupled to each other.

In some embodiments, and as illustrated in FIG. 9B (see also FIG. 1), a line 902 is in line with the top surface 102 of the follower platform and defines a plane of the platform. Similarly, line 904 is perpendicular to the front edge 112 of the front end 106 and in line with or defined by the bottom surface 132 of the follower platform (although lines 904 and 906 are not required to be perpendicular in all embodiments).

In some cases, angle $\theta_4$ defines an angle between the top surface 102 of the platform and the top surface 120 of the spacer 104. See angle $\theta_4$ in FIG. 9B, illustrating the top surface 102 and a plane 908 that is parallel to the line 902.

The angle of incidence of the top surface 102 of the follower can also be referenced to an inside or outside of the magazine. For instance, given a straight or curved magazine, the top surface 102 of the follower platform can be oblique to the front side of the magazine. More particularly, the acute angle $\theta_2$ can be measured between the top surface 102 of the follower and a front inside surface of the casing or magazine housing.

In other words, while prior art followers are arranged perpendicular to an inside front magazine casing, the herein disclosed follower 100 is designed to have a follower arranged obliquely to the inside front magazine casing. Where the magazine casing is curved or includes a curved portion, the acute angle $\theta_2$ can be measured relative to a tangent of the curved portion closest to the top surface of the follower platform 102 or a tangent point intersected by a plane of the top surface of the follower platform 102.

The acute angle $\theta_3$ tends to be a small angle such as 0.5° to 3°, and is dependent upon the type of cartridge with which the follower 100 is intended to be used, to provide improved feeding and/or traveling of the cartridges and follower. For example, if the associated cartridge has a taper or an induced taper of, for example, 1°, then the acute angle $\theta_3$ may be selected to be about one-half of the taper or induced taper of the cartridge, or about 0.5°. If the associated cartridge has a taper or induced taper of 3°, then the acute angle $\theta_3$ may be about 1.5°. In another example, a 7.62×39 cartridge case has about 2.7° of taper, meaning the acute angle may be about 1.35°. In still another example, a .22LR rimfire cartridge has up to 4° of equivalent stacking taper or induced taper, meaning the acute angle may be up to or about 2°. It should be understood that induced taper in a .22LR rimfire cartridge is caused by a portion of the rim abutting a surface, because the cartridge case itself is not tapered.

Given the above, the acute angle $\theta_2$ tends to be slightly less than 90°, such as between 87° and 89.5°. The obtuse angle $\theta_1$ tends to be slightly greater than 90°, such as between 90.5° and 93°. In some embodiments, the top surface 102 of the follower platform can be said to have an angle of incidence of $\theta_3$ and this angle of incidence can be between 0.5° to 3°.

In some embodiments, a top surface 120 of the spacer 104 can be parallel with a top surface 102 of the follower 100. However, in other embodiments, these two surfaces 102, 120 may be oblique. For instance, the top surface 120 of the spacer 104 may be tilted slightly downward toward a front of the follower 100 such that planes of the two surfaces 102, 120 intersect in front of the follower 100. The angle between these surfaces 102, 120 can be less than 1°, and preferably substantially 0.5° for 5.56 mm cartridges. This angle can be optimized for different cartridge tapering or induced tapering configurations thus shifting the force distribution on the last two rounds in the magazine so that more force is placed on the rounds' shoulder areas (either the point where the cartridge casing terminates or the point where the cartridge casing decreases circumference as it encompasses the bullet, depending on round manufacture) or rear regions. This lessens the chance of misfeed of the second to last round.

The follower 100 includes fins 128 and 130. The front fins 128 can be arranged on both the left and right sides of the follower 100 and can be shaped so as to interface with grooves or guiderails of an inside of a magazine casing (e.g., guiderails or rails 129 sitting just behind the fins in FIG. 10). As illustrated, the front fins 128 are three sided, with a flat back, flat side, and angled front. Also, the corners are beveled. However, this shape is in no way limiting and various other profiles of the front fins 128 can be used in order to interface with different arrangements and profiles of guiderails. For instance, the front fins 128 can have a profile that includes at least one angle. The profile of the front fins 128 can include at least one curved portion. The profile of the front fins 128 can include a flat front edge and/or a front edge that is perpendicular to a long axis of the follower 100 or perpendicular to a sidewall of the magazine casing.

The rear fins 130 can be arranged on both the left and right sides of the follower 100 and can be shaped so as to interface with sidewalls of the magazine casing. In some instances, the rear fins 130 can interface with guiderails of the magazine casing either in addition to or in contrast to the front fins 128. As illustrated, the rear fins 128 are three sided and all three sides are flat and substantially perpendicular to each other. However, this profile is in no way limiting, and many other profiles for the rear fins 130 can be implemented.

Figure 6:
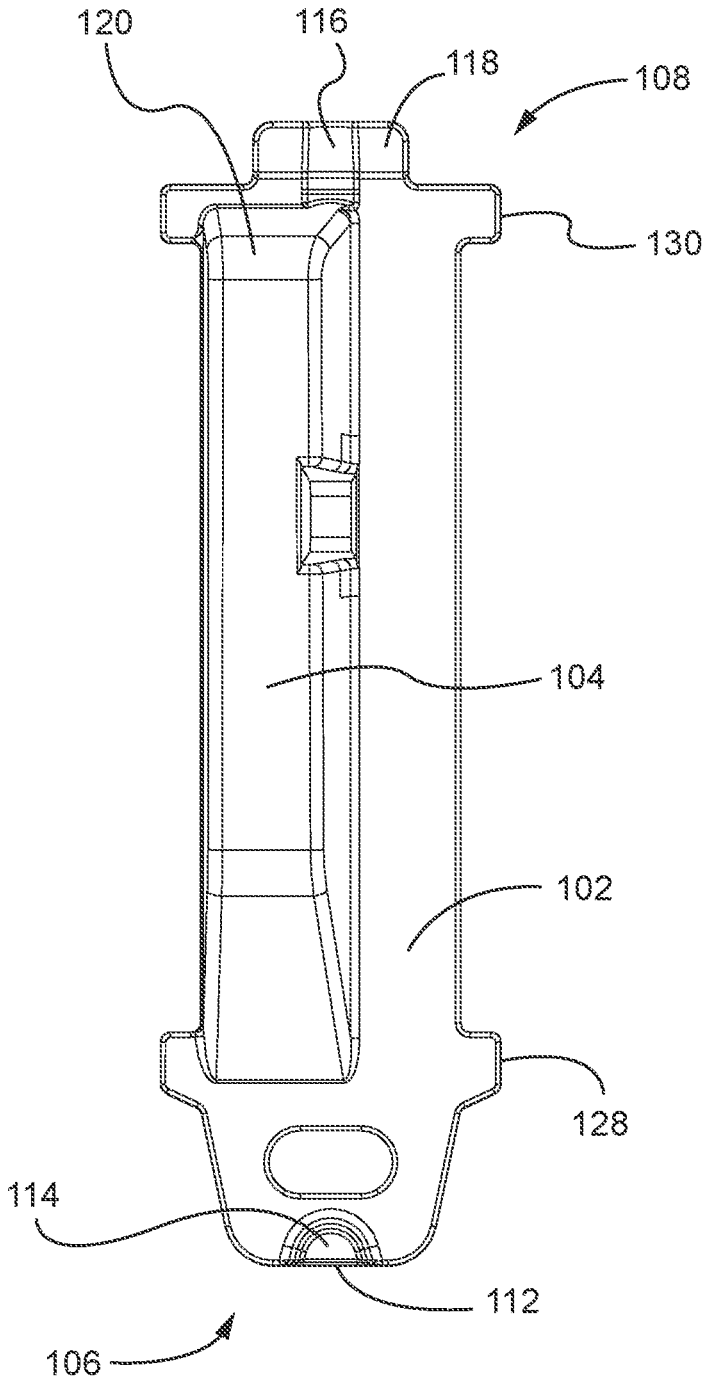
FIG. 6 is a top view of an exemplary follower.

Another feature of some embodiments of the follower 100 is the fashioning of the follower 100 in a manner to allow easier assembly of the magazine. As shown in FIGS. 6 and 7, fins 128 and 130 are fashioned to fit in recesses of the wall of the magazine, without interfering with the floor plate, and engage a stop in an extended position to prevent the follower 100 from escaping through a feed end of the magazine.

In some embodiments, the hind area of a spacer 104 is also designed to lessen misfeeding. Instead of a straight slope, the spacer 104 first tapers as a convex function, or has a beveled top rear edge as illustrated. The revised shape increases the force the bolt must exert on the round to actually cause a misfeed, thereby reducing its chance of occurrence. Put more succinctly, in use, the top surface 120 of the spacer is shaped to allow the bolt to ride over the spacer 104 more easily if the bolt catch fails to lock the bolt back, and proceeds forward in an attempt to "load" the spacer 104. If the top surface 120 were perpendicular relative to the top surface 102 of the platform, then the bolt group would be stopped up against the follower, which is undesirable.

It should be noted that the angle of the top surface 120 is also selected to not be so shallow, as this would cause the base of an adjacent cartridge to shift over and cause a misfeed.

Some embodiments of the follower 100 feature a bolt stop interface 118, having a recessed engagement 116, at the very rear of the follower 100, best seen in FIGS. 4 and 5. The bolt stop interface 118 is a small section extending from the top surface 102 of the follower, and may have a greater angle of incidence than the top surface 102 of the follower (i.e., the angle of incidence is slightly greater than $\theta_3$). The bolt stop interface 118 facilitates interaction with a bolt stop after the last round is fired. More specifically, the bolt stop interface 118 is angle upward, so as to hook the interfacing prong on the bolt catch in the rifle.

Figure 10:
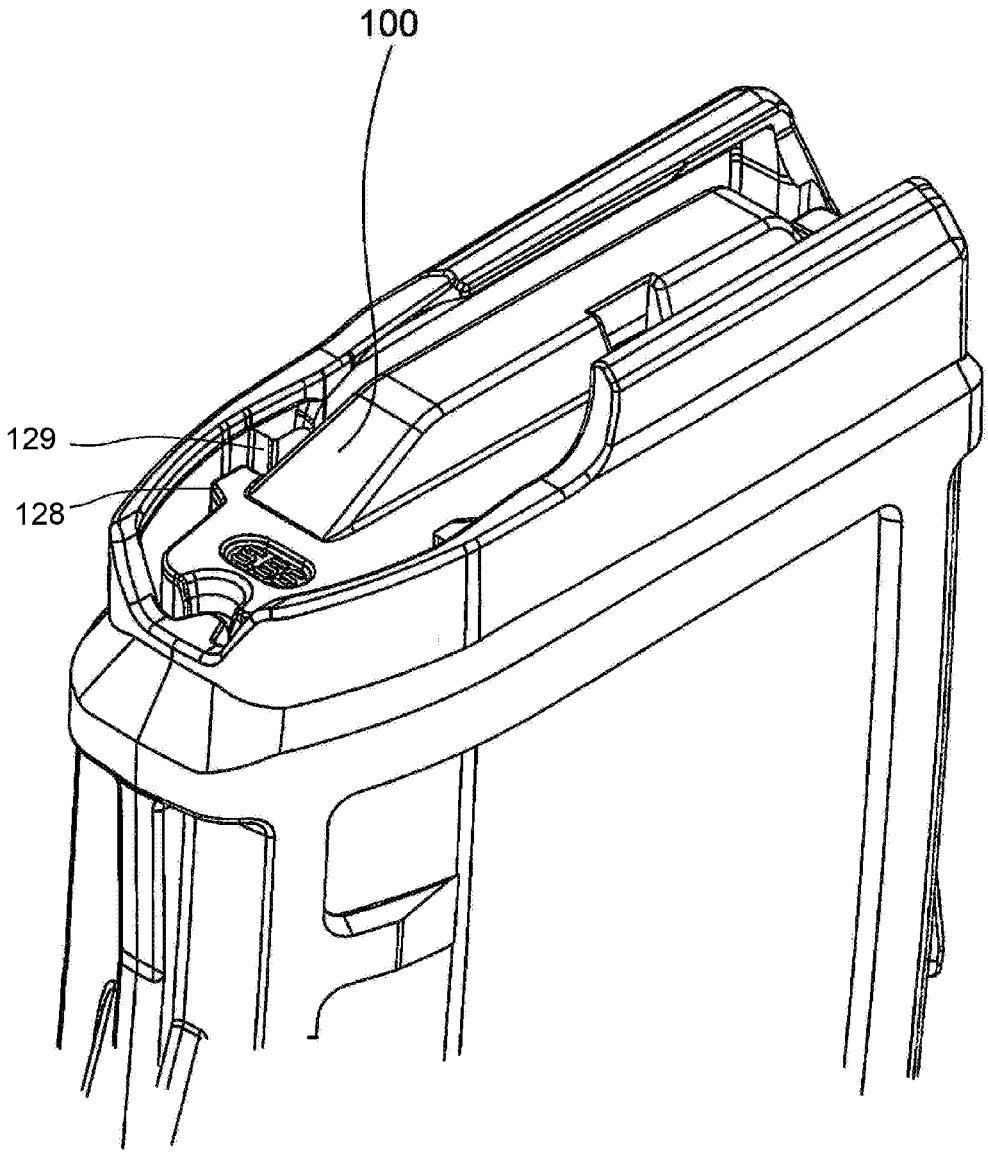
FIG. 10 is a perspective view of the follower depicted in FIG. 1 installed in a magazine.
Figure 11:
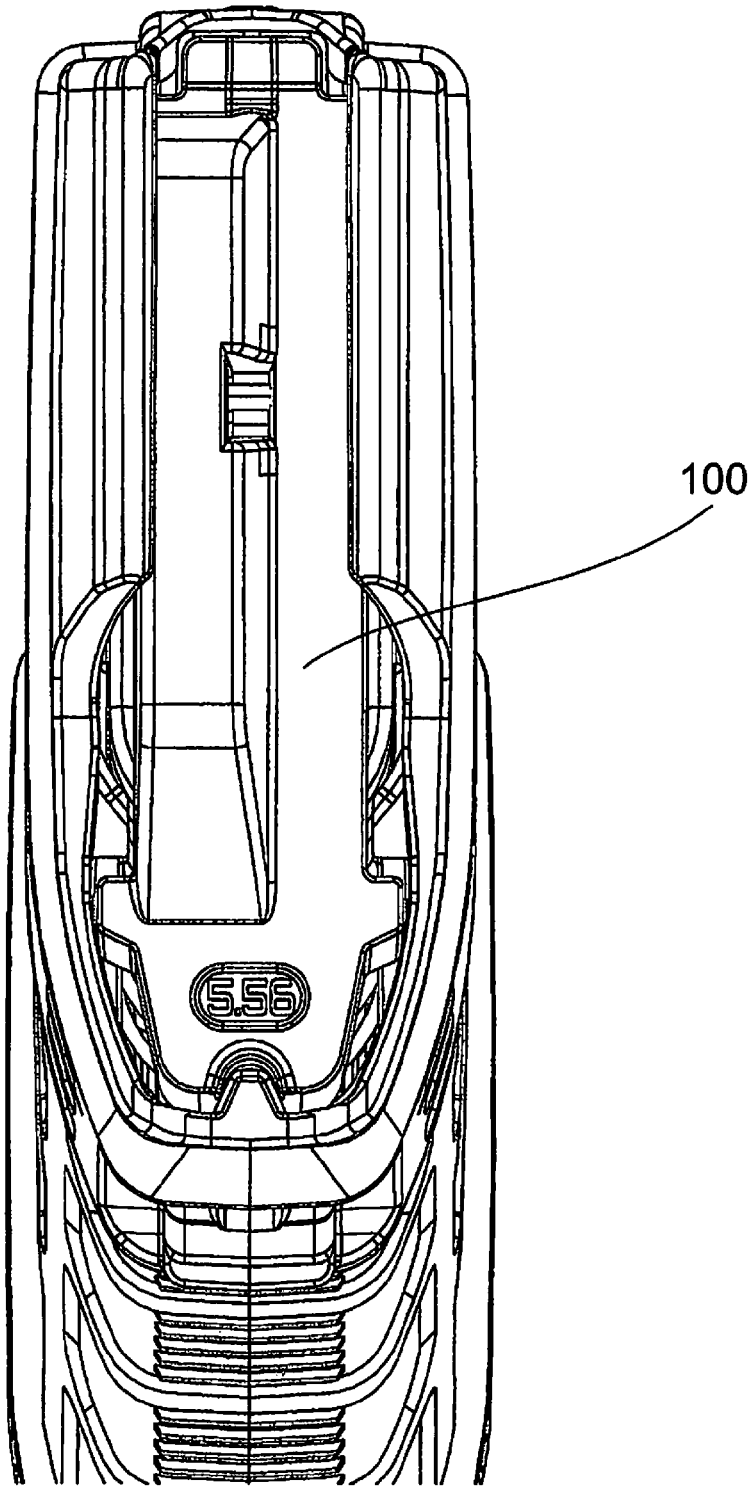
FIG. 11 is a top view of the follower depicted in FIG. 1 installed in a magazine.

FIGS. 10-11 show an embodiment of the herein disclosed follower 100 as implemented with a magazine. These illustrations help show how different features of the follower 100 interact with a magazine. While the illustrated magazine has certain features, such as the guiderails visible in FIG. 10, it will be recognized that other magazines can be used with the herein disclosed follower 100 without departing from the scope or spirit of the follower embodiments previously disclosed.

The herein disclosed follower and follower-magazine combination can be used in a variety of weapons platforms, and in particular those with radii of curvature of an inside or outside of the magazine casing where a center of the radius is on an opposite side of an axis parallel to the firearm's barrel and in line with a top edge of the magazine (e.g., Steyr AUG and Kalishnikov AK-47, to name two). Further, the herein disclosed follower and follower-magazine combination can be used in weapon systems having straight magazines or magazines with at least one straight portion, wherein the straight magazine or straight portion thereof is angled forward of a perpendicular to an axis through a center of the barrel (e.g., FN CAL and Giat FAMAS F1, to name two). The herein disclosed follower and follower-magazine combination also apply to platforms where the magazine includes straight and a curved sections and where either or both of the following criteria are met: the radius of curvature of an inside or outside of the magazine casing has a center that is on an opposite side of an axis running down a center of the barrel; or the straight section is angled forward of a perpendicular to the axis running down the center of the barrel. A non-exhaustive list of platforms where the herein disclosed follower or follower-magazine combinations can be implemented includes the following: HK G36, HK UMP, HK MP5, HK MP7, Steyr AUG, Steyr F88, Steyr F90, SIG 551, SIG 751, Kalashnikov AK-47, Kalashnikov AKM, Kalashnikov AK-74, Kalashnikov AK-101, Saiga 12, FN CAL, IMI Galil, Zastava M70, RK 95 TP, Valmet M76, Norinco Type 56, Giat FAMAS F1, M1 Carbine, and M2 Carbine.

Figure 12:
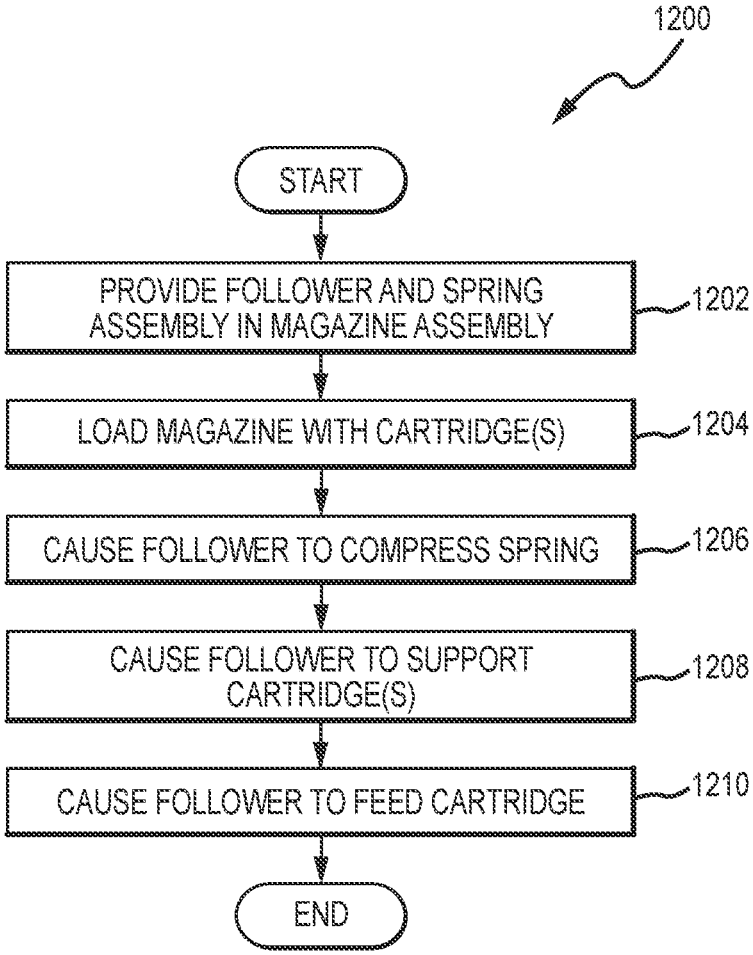
FIG. 12 is a flowchart of an exemplary method of using a follower.

Turning now to FIG. 12, a method 1200 of using a follower for a firearm magazine is now described. The method 1200 may include providing 1202 a follower and spring assembly in a magazine assembly, loading 1204 the magazine with at least one cartridge, causing 1206 the follower to compress the spring, causing 1208 the follower to support at least one cartridge, and causing 1210 the follower to feed at least one cartridge.

Providing 1202 a follower and spring assembly in a magazine assembly may be achieved by providing a follower having a platform and a spring receiving space, such that a plane defined by a top surface of the platform has an angle of incidence relative to the spring receiving space. In some embodiments, providing 1202 includes providing a follower having a spacer with an angle of incidence relative to the plane defined by the top surface. In some embodiments, providing 1202 includes providing a follower having a bolt stop interface that is obtuse to the plane defined by the top surface. Providing 1202 may be achieved using the follower described with reference to FIGS. 1-11 of this disclosure assembled with a spring assembly within a magazine as described herein.

Loading 1204 the magazine with at least one cartridge and causing 1206 the follower to compress the spring may be achieved simultaneously by inserting a cartridge into the magazine in a manner known in the art. Causing 1206 the follower to compress the spring may include causing the spring to compress along a vertical axis defined by a bottom surface of a platform of the follower while applying a force, such as by a cartridge, against a top surface of the platform, wherein the force is oblique to the vertical axis. Causing 1206 the follower to compress the spring in this manner may be achieved using a follower as described with reference to FIGS. 1-11 of this disclosure.

Similarly, causing 1208 the follower to support at least one cartridge may be achieved by allowing the spring to exert a force on the follower that is sufficient to maintain the cartridge pressed against the feed lips of the magazine. The follower may be shaped to translate a vertical force applied by the spring to a first oblique force on the cartridge.

Causing 1210 the follower to feed at least one cartridge may similarly be achieved by allowing the spring to cause the follower to exert a force on a cartridge supported by a spacer on the follower, such that the vertical force applied by the spring is translated into a second oblique force on the cartridge, wherein the second oblique force has a greater angle of incidence relative to a vertical axis defined by the bottom of the spring than an angle of incidence of the first oblique force.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A follower for a firearm magazine, comprising:

a platform shaped to support a cartridge and having a top surface and a bottom surface, the top surface defining at least one plane;

a spacer coupled to the platform, the spacer having a top surface shaped to support a cartridge being fed to a firearm;

a front end associated with a firing direction and coupled to a front portion of the platform, the front end having an interior surface for engaging a spring and an exterior surface for engaging a magazine body, the interior surface of the front end being substantially perpendicular to the bottom surface of the platform and forming an obtuse angle with the at least one plane of the platform; and a rear end coupled to a rear portion of the platform, the rear end having an interior surface for engaging the spring and an exterior surface for engaging the magazine body, the interior surface of the rear end perpendicular to the bottom surface of the platform and forming an acute angle with the at least one plane of the platform; wherein the front end extends further below the platform than does the rear end.

2. The follower of claim 1, wherein:

the top surface of the spacer is angled such that a rear portion of the top surface of the spacer is farther from the at least one plane of the platform than is a front portion of the top surface of the spacer.

3. The follower of claim 2, wherein:

the angle between the top surface of the spacer and the at least one plane of the platform is less than 1 degree.

4. The follower of claim 1, wherein:

the cartridge supported by the spacer comprises a cartridge case having a taper; and the angle between the top surface of the spacer and the at least one plane of the platform is one of (a) substantially one-half of the taper of the cartridge case and (b) substantially one-half of an induced taper defined by the cartridge case.

5. The follower of claim 1, further comprising:

a bolt stop interface projecting from a rear portion of the platform, the bolt stop interface having a stop shelf that is not parallel to the at least one plane of the platform.

6. The follower of claim 5, wherein:

a rear portion of the stop shelf of the bolt stop is farther from the at least one plane of the platform than is a front portion of the stop shelf of the bolt stop interface.

7. The follower of claim 1, wherein:

at least one of the front end and the rear end comprises at least one fin for engaging a rail in a firearm magazine.

8. The follower of claim 1, wherein:

a normal of the bottom surface of the platform defines a vertical axis of the follower; and the bottom surface, the front end, and the rear end define a spring receiving space, the spring receiving space shaped to limit an upper portion of the spring to vertical compression when the upper portion of the spring is compressed into the spring receiving space.

9. The follower of claim 8, further comprising:

a spring retention wall coupled to the platform and extending into the spring receiving space between the front end and the rear end, the spring retention wall shaped to limit the upper portion of the spring to vertical compression when the upper portion of the spring is compressed into the spring receiving space.

10. The follower of claim 1, wherein:

the obtuse angle is between 90.5 degrees and 93 degrees.

11. The follower of claim 1, wherein:

the acute angle is between 87 degrees and 89.5 degrees.

12. The follower of claim 1, wherein:

the interior surface of the front end forms an obtuse angle with the top surface of the platform.

13. A follower for a firearm magazine, comprising:

a platform shaped to support a cartridge and having a top surface and a bottom surface, the top surface defining at least one plane of the follower and a normal of the bottom surface of the platform defining a vertical axis of the follower;

a spacer coupled to the platform, the spacer set to a side of the top surface, the spacer having a top surface shaped to support a cartridge being fed to a firearm;

a front end coupled to a front portion of the platform, the front portion associated with a firing direction; and a rear end coupled to a rear portion of the platform; wherein an interior surface of the front end and an interior surface of the rear end define a spring receiving space shaped to limit an upper portion of a magazine spring to vertical compression when the upper portion of the magazine spring is compressed into the spring receiving space;

the interior surface of the front end forms an obtuse angle with the at least one plane of the platform; and the interior surface of the rear end forms an acute angle with the at least one plane of the platform.

14. The follower of claim 13, wherein the cartridge supported by the spacer comprises a cartridge case having a taper; and the top surface of the spacer is at an angle to the at least one plane of the platform such that a rear portion of the top surface of the spacer is farther from the at least one plane of the platform than is a front portion of the top surface of the spacer, wherein the angle between the top surface of the spacer and the at least one plane of the platform is one of (a) substantially one-half of the taper or (b) substantially one-half of an induced taper defined by the cartridge case.

15. The follower of claim 13, further comprising:

a bolt stop interface projecting from a rear portion of the platform, the bolt stop interface having a top surface; wherein a rear portion of the top surface of the bolt stop interface is farther from the at least one plane defined by the top surface of the platform than is a front portion of the top surface of the bolt stop interface.

16. The follower of claim 13, further comprising:

a spring retention wall extending substantially perpendicularly from the bottom surface of the platform between the front end and the rear end, and shaped to engage an interior region of a magazine spring as the magazine spring is compressed into the follower.

17. The follower of claim 13, wherein:

the obtuse angle between the interior surface of the front end and the at least one plane of the platform is between 90.5 degrees and 93 degrees; and the acute angle between the interior surface of the rear end and the at least one plane of the platform is between 87 degrees and 89.5 degrees.

18. The follower of claim 13, wherein:

the interior surfaces of the front end and the rear end form perpendicular angles with the bottom surface of the platform to limit an upper portion of the spring to vertical compression when the upper portion of the spring is compressed into the spring receiving space.

19. A follower for a firearm magazine, comprising:

a platform shaped to support a cartridge and having a top surface and a bottom surface, the top surface of the platform defining a first cartridge support plane and the bottom surface of the platform having a normal that defines a vertical axis of the follower;

a spacer coupled to the platform, the spacer having a top surface shaped to support a cartridge and defining a second cartridge support plane;

a front end coupled to a front portion of the platform, the front portion associated with a firing direction, the front end coupled to the front portion such that an interior surface of the front end is perpendicular to the bottom surface of the platform and forms an obtuse angle with the first cartridge support plane; and a rear end coupled to a rear portion of the platform such that an interior surface of the rear end is perpendicular to the bottom surface of the platform and forms an acute angle with the first cartridge support plane.

20. The follower of claim 19, wherein:

the second cartridge support plane is shaped to support a cartridge casing having a tapered rear portion; and wherein the second cartridge support plane is angled such that a rear portion of the second cartridge support plane is farther from the first cartridge support plane than is a front portion of the second cartridge support plane.

21. The follower of claim 19, further comprising:

a bolt stop interface projecting from a rear portion of the platform, the bolt stop interface having a top surface that is not parallel to the first cartridge support plane, wherein a rear portion of the bolt stop interface is farther from the first cartridge support plane than is a front portion of the bolt stop interface.

22. The follower of claim 19, wherein:

the obtuse angle between the interior surface of the front end and the first cartridge support plane is between 90.5 degrees and 93 degrees; and the acute angle between the interior surface of the rear end and the first cartridge support plane is between 87 degrees and 89.5 degrees.

23. The follower of claim 19, wherein:

the front end extends further below the platform than does the rear end.

* * * * *